US005219458A

United States Patent [19]

Bencriscutto

[11] Patent Number: 5,219,458

[45] Date of Patent: Jun. 15, 1993

[54] REVERSIBLE GOLF CLUB GRIP TRAINING AID HAVING INVERTABLE THUMB APERTURE

[76] Inventor: Matthew J. Bencriscutto, 6200 Northwestern Ave., Racine, Wis. 53406

[21] Appl. No.: 815,252

[22] Filed: Dec. 31, 1991

[51] Int. Cl.[5] ..... A63B 69/36

[52] U.S. Cl. ..... 434/252; 273/166; 273/189 R; 273/187.2

[58] Field of Search ..... 2/161 A, 161 R, DIG. 2; 434/252; 273/188 R, 189 R, 166, 183 B

[56] References Cited

U.S. PATENT DOCUMENTS

| | | | |
|---|---|---|---|
| 1,681,389 | 8/1928 | Blake | 273/166 |
| 2,447,328 | 8/1948 | Gerrits | 273/166 |
| 3,255,462 | 6/1966 | Antonious | 273/166 |
| 4,752,075 | 6/1988 | Bencriscutto | 273/189 X |

OTHER PUBLICATIONS

Advertising Flyer Entitled "Rite Grip Glove" published in about Mar., 1990.

*Primary Examiner*—John J. Wilson
*Assistant Examiner*—Jeffrey A. Smith
*Attorney, Agent, or Firm*—Andrus, Sceales, Starke & Sawall

[57] ABSTRACT

The golf club grip training aid enables the golfer's hand to be properly positioned with respect to each other while maintaining a comfortable grip on the golf club shaft. The training aid includes a band of flexible material having an aperture for receiving the thumb of a first hand, and an adjustable loop adjacent to the aperture that receives the thumb of the second hand. The adjustable loop accommodates different sizes of thumbs, and preferably includes two loop portions each of which is attached to the band. The two loop portions have mating VELCRO brand hook and loop fasteners which allow the relative positions of the two loop portions to be changed to adjust the loop size. The training aid is also reversible in that it may be used on either hand by moving the loop through a slot in the band that adjoins the loop. When the training aid is to be reversed, the band is wrapped on the second hand and the loop is moved through the slot and adjusted to accommodate the thumb of the first hand.

16 Claims, 3 Drawing Sheets

FIG. 1
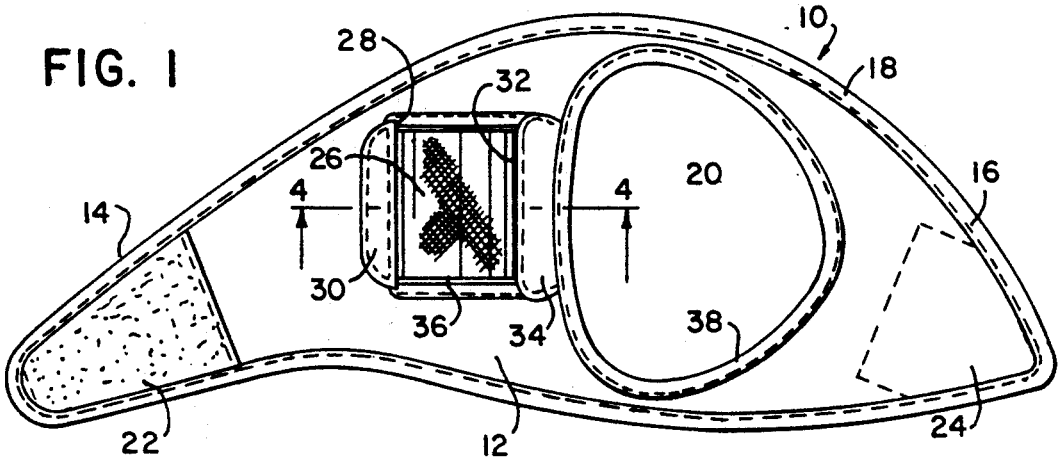
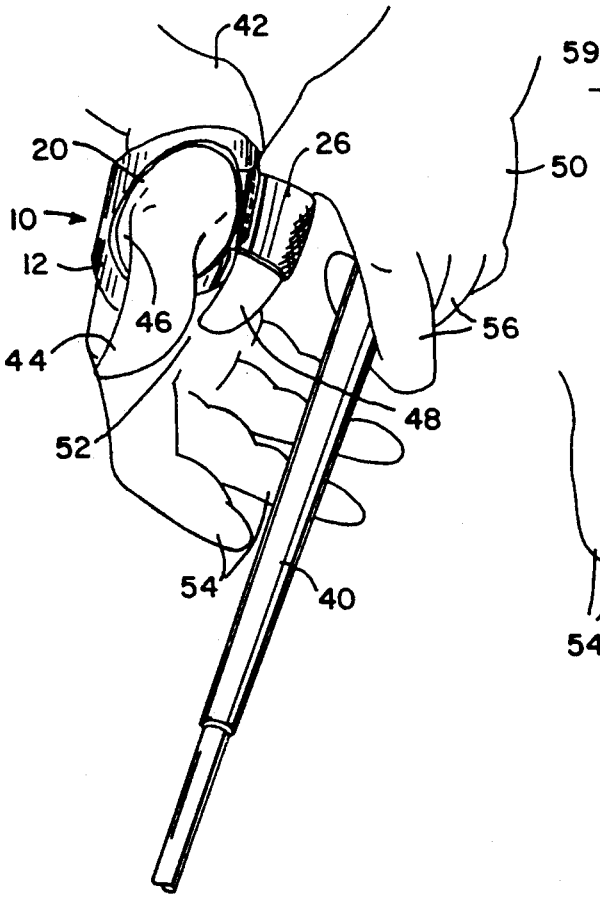
FIG. 2
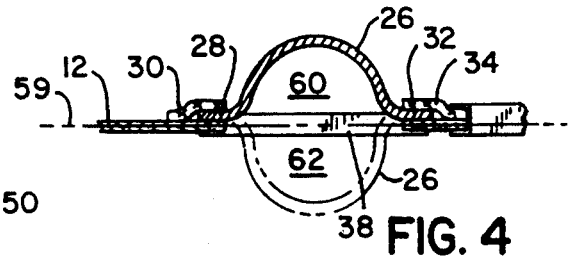
FIG. 4
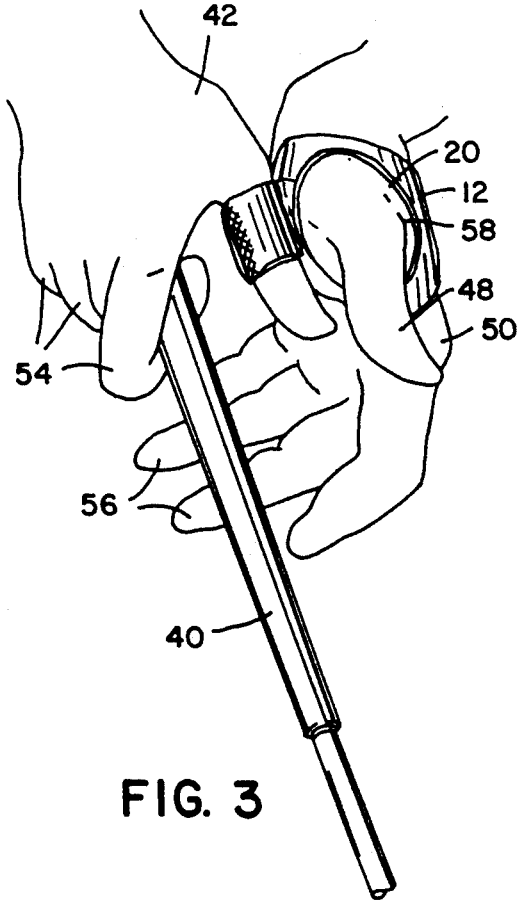
FIG. 3

REVERSIBLE GOLF CLUB GRIP TRAINING AID HAVING INVERTABLE THUMB APERTURE

BACKGROUND OF THE INVENTION

The present invention relates to a golf training aid used to train golfers to keep their hands correctly positioned on the golf club. More particularly, the present invention relates to a golf training aid having a band of flexible material or a glove that is worn on one hand of a golfer.

Several types of golf club grip training aids are known which assist the golfer in keeping his hands properly positioned on the golf club during a swing. For example, U.S. Pat. No. 2,782,422 issued Feb. 26, 1957 to Michael Bencriscutto discloses a golf training glove to be worn on one hand and having a means for receiving a thumb of the other hand to insure that the club is properly gripped. One disadvantage of the '422 Bencriscutto glove is that the loop that receives the thumb from the other hand is of a fixed size, and is not readily adapted to different size thumbs or hands of different sizes. Thus, the glove may be awkward or uncomfortable to use for some players, and may be stretched by the golfer if it does not fit properly. Another disadvantage of the '422 Bencriscutto training glove is it is not reversible; a separate glove must be used for right-handed players and for left-handed players.

Other prior art golf training gloves likewise have the disadvantages of being non-reversible, and nonadjustable. See U.S. Pat. No. 4,752,075 issued Jun. 21, 1988 to Michael Bencriscutto; and U.S. Pat. No. 3,725,957 issued Apr. 10, 1973 to Shotmeyer. U.S. Pat. No. 2,474,030 issued Jun. 21, 1949 to Braswell discloses a unique, non-slip golf glove wherein the distance between the two glove parts may be adjusted, but does not disclose any means for retaining the thumbs, nor for adjusting the size of any finger holes.

SUMMARY OF THE INVENTION

An improved golf club grip training aid is both reversible so that it may be worn on either hand, and has an adjustable thumb receiving means. Thus, the single glove is able to accommodate a wide variety of hand and thumb sizes, as well as both right and left-handed golfers.

The golf training aid according to the present invention includes a band of flexible material such as a glove adapted to be wrapped on a first hand of the player. The flexible band includes opposite first and second ends and first fastening means on the ends, such as a VELCRO brand hook and loop fastener, for holding the ends of the band together when the bad is wrapped on the first hand. The band also includes an aperture that receives the thumb and its base of the first hand, and a slot through which a flexible loop is moved when the glove is reversed.

The flexible, elastic loop is positioned adjacent to the aperture and is adapted to receive the thumb of the second hand when the band is wrapped on the first hand. The loop has a first loop end affixed to the band and is positioned adjacent to the slot so that the loop may be moved through the slot when the glove is reversed and worn on the second hand.

The training aid also preferably includes a means for adjusting the size of the loop to accommodate different sized thumbs. The adjustment means preferably includes a first loop portion having a first loop end sewn to a first pad on the band, and a second loop portion having a second loop end sewn to a second pad on the band hook and loop. The first loop portion has a first VELCRO brand fastener, and the second loop portion has a mating second VELCRO brand hook and loop fastener opposite to the first VELCRO brand hook and loop fastener. The size of the loop is adjusted by changing the relative positions of the first and second VELCRO brand hook and loop fasteners.

In an alternate embodiment, the adjustment means may include a clip attached to the band having a clip aperture through which a loop end is passed. This loop end is fastened back to the loop itself by a second fastening means which preferably includes a VELCRO brand hook and loop fastener on both the loop end and on a side of the loop itself.

To use the training aid on the second hand, the band of flexible material is wrapped on the second hand with the second hand thumb being placed through the aperture, and the loop being moved through the adjoining slot. The band ends are then fastened together around the second hand, and the thumb on the first hand is placed in the loop. The golf club is then gripped by the two hands.

It is a feature and advantage of the present invention to provide a golf club grip training aid that may be worn on either hand.

It is another feature and advantage of the present invention to provide a golf training aid that is adjustable to accommodate hands of different sizes.

These and other features and advantages of the present invention will be apparent to those skilled in the art from the following detailed description of preferred embodiments and the attached drawings, in which:

BRIEF DESCRIPTION OF THE DRAWINGS

FIG. 1 is a plan view of a reversible golf training aid according to the present invention.

FIG. 2 depicts the golf training aid of FIG. 1 being used by a right-handed golfer.

FIG. 3 depicts the golf training aid of FIG. 1 being used by a left-handed golfer.

FIG. 4 is a cross-sectional view of the golf training aid of FIG. 1, taken along line 4—4.

DETAILED DESCRIPTION OF THE PREFERRED EMBODIMENT

Figure 5:
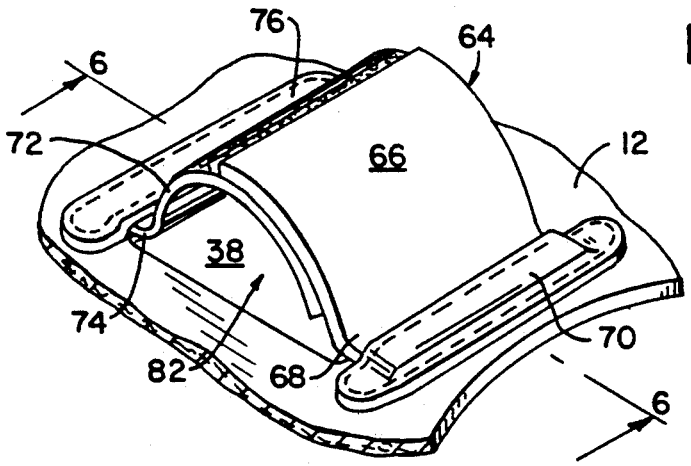
FIG. 5 is a perspective view depicting an adjustable thumb loop according to the present invention.

FIG. 1 is a plan view of a reversible golf club grip training aid according to the present invention. In FIG. 1, training aid 10 includes an elongated band 12 of flexible material having a first end 14 and a second end 16. In the alternative, band 12 could be shaped like a halfglove which may or may not have distinct finger holes for receiving the fingers.

Referring again to FIG. 1, band 12 is preferably made from a leather or vinyl material, although other materials could be used. The outer perimeter of band 12 includes a cloth binding 18 which provides a finished look to the product and also strengthens the band. The band also includes a thumb receiving means or aperture 20 that is large enough to receive both the thumb and the thumb base of the hand around which band 12 is wrapped.

After the band is wrapped on a first hand and the first hand thumb is placed through aperture 20, band ends 14 and 16 are fastened together by a fastener means consisting of fastener 22 on first band end 14, and fastener 24 shown in phantom on second band end 16. Fasteners 22 and 24 are preferably mating portions of a VELCRO brand hook and loop fastener, although other fasteners such as snaps or clips may be used.

The training aid depicted in FIG. 1 also includes a flexible loop 26 made of a strong elastic material. A first loop end 28 is attached to band 12 by being sewn thereto along with a pad 30. Similarly, the other loop end 32 is attached to band 12 by being sewn thereto along with a pad 34. Located beneath loop 26 is a slot 38 (FIG. 4) through which the loop is moved when training aid 10 is reversed and placed on the second hand. Loop 26 may then receive the thumb from the first hand. As shown in FIG. 1, loop 26 is preferably positioned adjacent to aperture 20 to provide the correct golf club grip. Aperture 20 also has a cloth binding 38 which provides finish and strength to the perimeter of the aperture.

FIGS. 2 and 3 depict a golf club shaft 40 being gripped using training aid 10 according to the present invention. In FIG. 2, the training aid is being used by a right-handed golfer. In FIG. 3, the training aid is being used by a left-handed golfer.

Referring to FIG. 2, band 12 is wrapped around right hand 42 of the golfer, with right hand thumb 44 and its base 46 being received in aperture 20. Thumb 48 of the golfer's left hand 50 is then placed all the way through loop 26 so that it is in the proper position adjacent to thumb 44 and palm 52 of the right hand. Golf club shaft 40 is then gripped by fingers 54 of the right hand and fingers 56 of the left hand.

To use the training aid for a left-handed grip as depicted in FIG. 3, band 12 is wrapped around left hand 50. Thumb 48 of the left hand along with its base 58 are received through aperture 20 in the band. Loop 26 is then moved through slot 39 (FIG. 4) so that it is in a position to receive thumb 44 of right hand 42. Fingers 54 of the right hand and fingers 56 of the left hand then grip golf club shaft 40 as depicted in FIG. 3.

FIG. 4 is a cross-sectional view of the loop of FIG. 1 which more clearly depicts the reversible feature of the present invention. In FIG. 4, loop 26 and horizontal plane 59 of band 12 define a thumb receiving space 60 for receiving the second hand thumb when the training aid is wrapped around the first hand. When the training aid is reversed so that it is wrapped around the second hand, loop 26 is moved through slot 39 to the phantom position shown in FIG. 4. Loop 26 and plane 59 then define a space 62 for receiving the thumb of the first hand.

Figure 6:
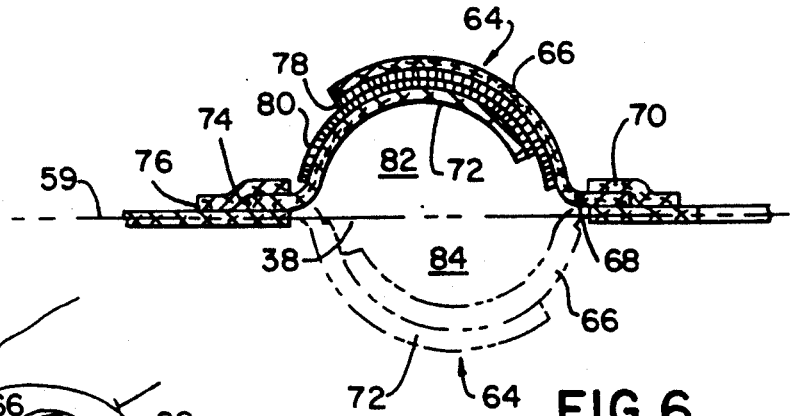
FIG. 6 is a cross-sectional view of the loop of FIG. 5, taken along line 6.6
Figure 7:
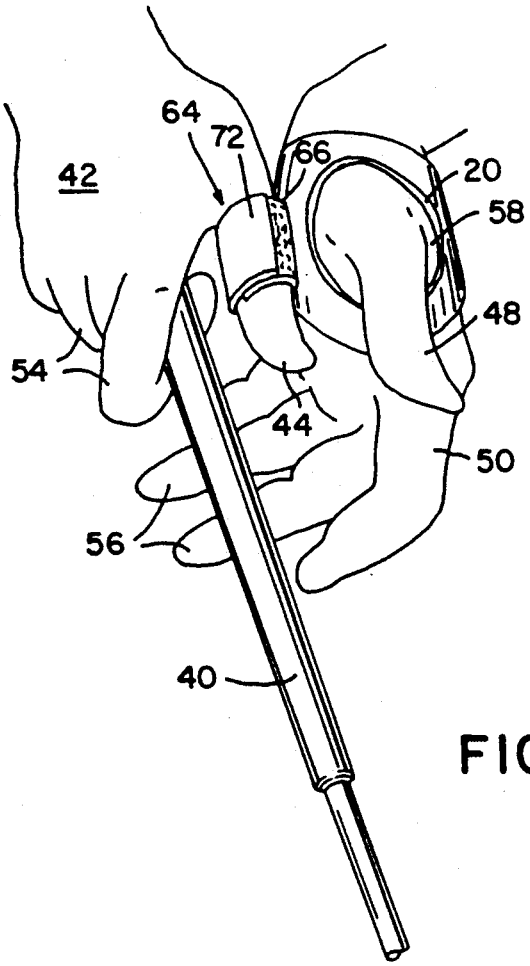
FIG. 7 depicts the reversible, adjustable golf training aid being used by a left-handed golfer.

FIGS. 5 through 7 depict another major feature of the present invention, namely an adjustable thumb loop. In FIGS. 5 through 7, the adjustable thumb loop feature is shown as being combined with the reversible feature to provide maximum versatility for the golf training aid according to the present invention. In all the Figures, components having corresponding functions have been given the same numerical designations.

Referring to FIGS. 5 and 6, band 12 has a slot 39 therein which enables the training aid to be reversed in a manner similar to that described above in connection with FIGS. 1 through 4. The reversed position of the loop is depicted in phantom in FIG. 6.

In FIGS. 5 and 6, loop 64 includes a first loop portion 66 that has an end 68 which is sewn to band 12 along with a pad 70. A second loop portion 72 of loop 64 has an end 74 that is sewn to band 12 along with a pad 76.

As best shown in FIG. 6, the loop adjustment means includes a second fastener means which holds first loop portion 66 and second loop portion 72 together. Specifically, first loop portion 66 has a first VELCRO brand hook and loop fastener 78 on an inner side thereof, and second loop portion 72 has a mating second VELCRO brand hook and loop fastener 80 on an outer side thereof. The size of the loop is adjusted by changing the relative positions of first fastener 78 and second fastener 80 to each other, and then attaching the fasteners to each other.

The use of the loop adjustment means allows the size of loop 64 and thus the size of thumb receiving space 82, defined by loop 64 and horizontal plane 59, to be adjusted to accommodate different thumb sizes. Similarly, the adjustment means allows thumb receiving space 84, defined by loop 64 (shown in phantom) and plane 59 to also be adjusted when the band is reversed and used on the other hand.

VELCRO brand hook and loop fasteners are particularly desirable for the second fastening means for several reasons. First, they are easily fastened and unfastened. Second, fastener 78 will tend to be separated from fastener 80 if the player is making a major mistake in his swing, thereby indicating that a swing correction is needed. Third, the VELCRO brand hook and loop fasteners enable the loop size to be adjusted as the loop stretches with use.

FIG. 7 depicts the use of the adjustable, reversible training aid according to the present invention by a left-handed golfer. In FIG. 7, band 12 is wrapped around left hand 50 of the golfer so that right thumb 48 and its base 58 are received in aperture 20. After the band ends have been fastened together for a snug fit on the left hand, right thumb 44 is passed through adjustable loop 64, and the length of the loop is adjusted by the adjustment means to accommodate thumb 44. Fingers 54 and 56 on the right and left hands respectively then grip golf club shaft 40.

Figure 8:
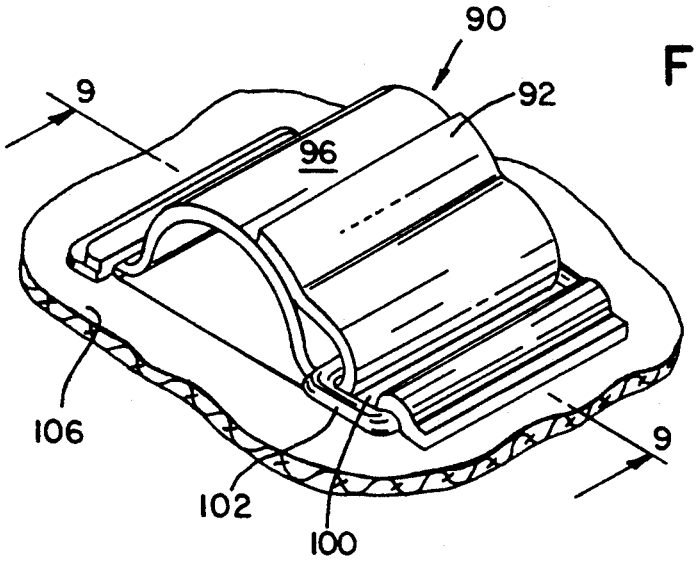
FIG. 8 is a perspective view depicting an adjustable thumb loop according to the present invention having a single loop portion.
Figure 9:
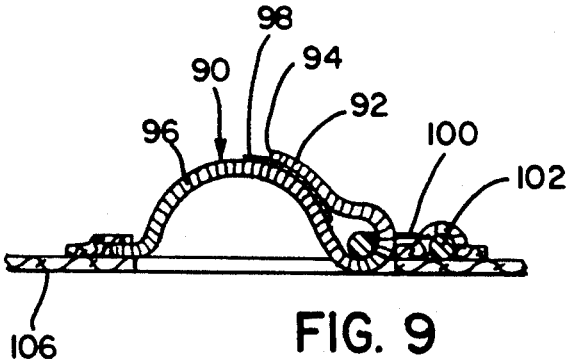
FIG. 9 is a cross-sectional side view of the embodiment having a single loop portion, taken along line 9—9 of FIG. 8.
Figure 10:
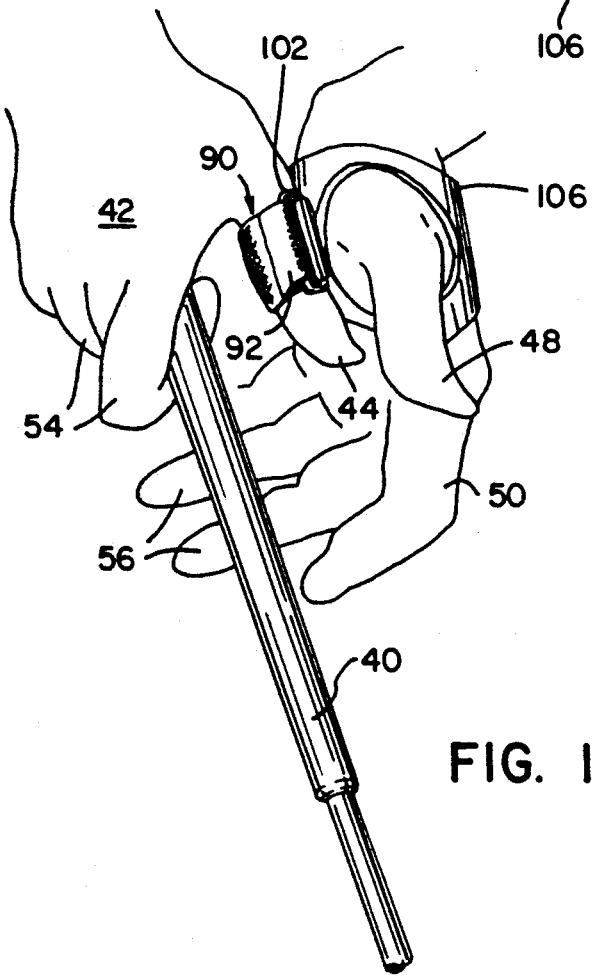
FIG. 10 depicts the golf training aid of FIG. 8 being used by a right-handed golfer.

The loop adjustment means may have other configurations. In one embodiment depicted in FIGS. 8–10, loop 90 may comprise a single portion, with a single loop end 92. Loop end 92 has one type 94 of a VELCRO brand hook and loop fastener; a side 96 of loop 90 has a mating type 98 of a VELCRO brand hook and loop fastener. Loop end 92 is placed through an aperture 100 in a clip 102 and is then wrapped around clip 102. Clip 102 is attached to band 106. Loop end 92 is then fastened back to loop side 96 so that the two VELCRO brand hook and loop fasteners 94 and 98 are attached to each other.

The golf training aid according to the present invention enables both of the golfer's hands to work together in achieving a comfortable yet firm grip on the golf club shaft. The training aid teaches the golfer to keep his hands in the proper position with respect to each other while at the same time providing individual adjustment and a degree of comfort not found in any of the prior art golf training aids.

While several preferred embodiments of the present invention have been shown and described, other alternate embodiments will be apparent to those skilled in the art and within the intended scope of the present invention. Thus, the invention is to be limited only by the following claims.

I claim:

1. A golf training aid which may be worn on a first hand of a player who has a first hand and a second hand, each hand having a thumb, said training aid comprising:
- a band of flexible material adapted to be wrapped on said first hand, including
  - a first end;
  - a second end opposite said first end;
  - an aperture that receives the thumb of said first hand;
- fastening means on said first end and on said second end for holding the ends of said band together when said band is wrapped on said first hand;
- a flexible loop adjacent to said aperture and having a first loop end affixed to said band, said loop adapted to receive the thumb of said second hand; and
- means for adjusting the size of said loop.

2. The golf training aid of claim 1, wherein said flexible loop includes a hook and loop fastener.

3. The golf training aid of claim 1, wherein said fastening means includes a hook and loop fastener.

4. The golf training aid of claim 1, wherein said loop has a second loop end opposite said first loop end, and wherein said adjusting means further comprises:
- a clip interconnected with said band and having an aperture therein; and
- a second fastening means for fastening said second loop end to said loop after said second loop end has been passed through said clip aperture.

5. A reversible, adjustable golf training aid which may be worn on either hand of a player who has a first hand and a second hand, each hand having a thumb, said training aid comprising:
- a band of flexible material adapted to be wrapped on either of said hands, including:
  - a first end;
  - a second end opposite said first end;
  - an aperture adapted to receive the thumb of either of said hands;
  - a slot;
- first fastening means on said first end and on said second end for holding the ends of said band together when said band is wrapped on either of said hands;
- a flexible loop adjacent to said aperture and having a first loop end affixed to said band, said loop adapted to receive the thumb of said second hand when said band is wrapped on said first hand, said loop also adjoining said slot such that the loop is moved through the slot to receive the thumb of said first hand when said band is reversed and wrapped on said second hand; and
- means for adjusting the size of said loop.

6. The golf training aid of claim 5, wherein said loop is made from an elastic material.

7. The golf training aid of claim 5, wherein said first fastening means includes a hook and loop fastener.

8. The golf training aid of claim 5, wherein said loop has a second loop end opposite said first loop end, and wherein said adjusting means further comprises:
- a clip interconnected with said band and having an aperture therein; and
- a second fastening means for fastening said second loop end to said loop after said second loop end has been passed through said clip aperture.

9. A golf training aid which may be worn on a first hand of a player who has a first hand and a second hand, each hand having a thumb, said training aid comprising:
- a band of flexible material adapted to be wrapped on said first hand, including:
  - a first end;
  - a second end opposite said first end;
  - an aperture that receives the thumb of said first hand;
- fastening means on said first end and on said second end for holding the ends of said band together when said band is wrapped on said first hand; p1 a flexible loop adjacent to said aperture and having a first loop end affixed to said band, said loop adapted to receive the thumb of said second hand, said loop including
  - a first loop portion having said first loop end;
  - a second loop portion having a second loop end affixed to said band; and
- means for adjusting the size of said loop.

10. The golf training aid of claim 9, wherein said adjusting means includes a second fastening means for fastening said first loop portion to said second loop portion.

11. The golf training aid of claim 10, wherein said first loop portion has an inner side and wherein said second loop portion has an outer side, and wherein said second fastening means includes:
- a first hook and loop fastener attached to an inner side of said first loop portion; and
- a second hook and loop fastener attached to an outer side of said second loop portion that is opposite to said inner side.

12. A reversible, adjustable golf training aid which may be worn on either hand of a player who has a first hand and a second hand, each hand having a thumb, said training aid comprising:
- a band of flexible material adapted to be wrapped on either of said hands, including:
  - a first end;
  - a second end opposite said first end;
  - an aperture adapted to receive the thumb of either of said hands;
  - a slot;
- first fastening means on said first end and on said second end for holding the ends of said band together when said band is wrapped on either of said hands;
- a flexible loop adjacent to said aperture and having a first loop end affixed to said aperture and adapted to receive the thumb of said second hand when said band is wrapped on said first hand, said loop also adjoining said slot such that the loop is moved through the slot to receive the thumb of said first hand when said band is reversed and wrapped on said second hand, said loop including
  - a first loop portion having said first loop end;

a second loop portion having a second loop end affixed to said band; and means for adjusting the size of said loop.

13. The golf training aid of claim 12, wherein said adjusting means includes a second fastening means for fastening said first loop portion to said second loop portion.

14. The golf training aid of claim 13, wherein said first loop portion has an inner side and wherein said second loop portion has an outer side, and wherein said second fastening means includes:

a first hook and loop fastener attached to an inner side of said first loop portion; and a second hook and loop fastener attached to an outer side of said second loop portion that is opposite to said inner side.

15. A reversible golf training aid which may be worn on either hand of a player who has a first hand and a second hand, each hand having a thumb, said training aid comprising:

a band of flexible material adapted to be wrapped on either of said hands, including a first end;

a second end opposite said first end;

an aperture adapted to receive the thumb of either of said hands;

a slot;

fastening means on said first end and on said second end for holding the ends of said band together when said band is wrapped on either of said hands; and a flexible elastic loop affixed to said band and adjacent to said aperture that receives the thumb of the second hand when said band is wrapped on said first hand, said loop also adjoining said slot such that the loop is moved through said slot to receive the thumb of said first hand when said band is reversed and wrapped on said second hand.

16. A reversible golf training aid which may be worn on either hand of a player who has a first hand and a second hand, each hand having a thumb, said training aid comprising:

a band of flexible material adapted to be wrapped on either of said hands, including a first end;

a second end opposite said first end;

an aperture adapted to receive the thumb of either of said hands;

a slot;

fastening means on said first end and on said second end for holding the ends of said band together when said band is wrapped on either of said hands, said fastening means including a hook and loop fastener; and a flexible loop affixed to said band and adjacent to said aperture that receives the thumb of the second hand when said band is wrapped on said first hand, said loop also adjoining said slot such that the loop is moved through said slot to receive the thumb of said first hand when said band is reversed and wrapped on said second hand.

* * * * *

UNITED STATES PATENT AND TRADEMARK OFFICE

CERTIFICATE OF CORRECTION

PATENT NO. : 5,219,458

DATED : June 15, 1993

INVENTOR(S) : Bencriscutto

It is certified that error appears in the above-identified patent and that said Letters Patent is hereby corrected as shown below:

CLAIM 9, Col. 6, Line 22, after "hand;" delete

--- p1---

Signed and Sealed this

Eighteenth Day of January, 1994

*Attest:*

Bruce Lehman

BRUCE LEHMAN

*Attesting Officer*

*Commissioner of Patents and Trademarks*